US011624219B2

(12) United States Patent
Schmück

(10) Patent No.: US 11,624,219 B2
(45) Date of Patent: Apr. 11, 2023

(54) DOOR LOCK ADAPTER

(71) Applicant: Uhlmann & Zacher GmbH, Waldbüttelbrunn (DE)

(72) Inventor: Karl-Heinz Schmück, Waldbüttelbrunn (DE)

(73) Assignee: UHLMANN & ZACHER GmbH, Waldbüttelbrunn (DE)

( * ) Notice: Subject to any disclaimer, the term of this patent is extended or adjusted under 35 U.S.C. 154(b) by 0 days.

(21) Appl. No.: 17/703,182

(22) Filed: Mar. 24, 2022

(65) Prior Publication Data

US 2022/0213723 A1 Jul. 7, 2022

Related U.S. Application Data

(63) Continuation of application No. PCT/EP2020/076900, filed on Sep. 25, 2020.

(30) Foreign Application Priority Data

Sep. 25, 2019 (EP) ..... 19199451

(51) Int. Cl.
*E05C 1/12* (2006.01)
*E05B 9/02* (2006.01)
(Continued)

(52) U.S. Cl.
CPC ..... *E05C 1/12* (2013.01); *E05B 9/02* (2013.01); *E05B 17/0004* (2013.01);
(Continued)

(58) Field of Classification Search
CPC ..... E05B 47/068; E05B 55/005; E05B 9/02; E05B 17/0004; E05B 63/08;
(Continued)

(56) References Cited

U.S. PATENT DOCUMENTS 339,245 A * 4/1886 Winkle ..... E05B 55/005 292/341.12
508,541 A * 11/1893 Gray ..... E05B 55/005 292/341.12
(Continued)

OTHER PUBLICATIONS

European Patent Office, Extended Search Report, Application No. 19199451.6, dated Mar. 20, 2020, 9 pages.
(Continued)

*Primary Examiner* — Christine M Mills
*Assistant Examiner* — Faria F Ahmad
(74) *Attorney, Agent, or Firm* — Quarles & Brady LLP; Yakov S. Sidorin

(57) ABSTRACT

An adapter configured to convert a rotary motion of a drive shaft for a door lock actuating mechanism into a translational motion for actuating a door latch. The adapter includes a housing with a compartment and a first lever inside the compartment, enables retrofitting of US-style doors with a European style door handle by providing a first bearing that rotatably supports the first lever relative to the housing, wherein the first bearing has a first axis of rotation, wherein the housing has a channel, the channel has a first opening facing the lever and a second opening facing away from the lever, wherein a first channel axis extends through the centers of the first and second openings. The first lever has a hole, configured for receiving the drive shaft, wherein the longitudinal axis of the drive shaft correlates with the first axis of rotation. The first lever further has first coupling means for providing a torque proof coupling with the drive shaft. A second bearing pivotably attaches the lever to a connecting rod, where-in the second bearing has a second axis of rotation, wherein the connecting rod has a first connecting element at the end of the connecting rod opposite to the lever. The first connecting element is moveably supported inside the first channel, wherein the channel walls
(Continued)

limit a translation of the first connecting element in directions perpendicular to the first channel axis and enable a translation along the first channel axis.

17 Claims, 4 Drawing Sheets

(51) Int. Cl.

| | |
|---|---|
| ***E05B 17/00*** | (2006.01) |
| ***E05B 63/08*** | (2006.01) |
| ***E05B 15/04*** | (2006.01) |
| ***E05B 63/04*** | (2006.01) |
| ***E05B 55/00*** | (2006.01) |
| ***E05B 47/06*** | (2006.01) |
| ***E05C 1/16*** | (2006.01) |
| ***E05C 1/06*** | (2006.01) |

(52) U.S. Cl.
CPC ..... *E05B 47/068* (2013.01); *E05B 55/005* (2013.01); *E05B 63/04* (2013.01); *E05B 63/08* (2013.01); *E05B 2015/0413* (2013.01); *E05C 1/06* (2013.01); *E05C 1/163* (2013.01); *Y10T 292/1047* (2015.04); *Y10T 292/57* (2015.04); *Y10T 292/91* (2015.04)

(58) Field of Classification Search
CPC ..... E05B 2015/0413; E05B 63/04; E05C 1/163; E05C 1/12; E05C 1/06; Y10T 292/06; Y10T 292/0974; Y10T 292/1047; Y10T 292/57; Y10T 292/91; Y10T 292/098; Y10T 292/0983; Y10T 292/0984; Y10T 292/62; Y10T 70/5341
See application file for complete search history.

(56) References Cited

U.S. PATENT DOCUMENTS

| | | | | | |
|---|---|---|---|---|---|
| 689,334 | A * | 12/1901 | Taylor | E05C 1/16 | 292/169.21 |
| 1,066,021 | A * | 7/1913 | Kuske | E05B 85/22 | 292/DIG. 49 |
| 1,728,263 | A * | 9/1929 | Ellingson | E05B 55/005 | 70/156 |
| 1,829,814 | A * | 11/1931 | Schlage | E05C 1/16 | 292/169.21 |
| 1,829,815 | A * | 11/1931 | Schlage | E05C 1/163 | 292/169.22 |
| 1,839,406 | A * | 1/1932 | McLaughlin | E05B 55/00 | 70/150 |
| 1,876,080 | A * | 9/1932 | Schlage | E05B 55/005 | 70/151 R |
| 2,420,083 | A * | 5/1947 | Lickteig | E05B 55/005 | 70/156 |
| 3,203,719 | A | 8/1965 | Moore | | |
| 3,606,422 | A * | 9/1971 | Hennessy | E05B 63/0017 | 292/336.5 |
| 3,751,085 | A * | 8/1973 | Sanders | E05B 63/0017 | 292/DIG. 52 |
| 3,799,592 | A * | 3/1974 | Babb, Jr. | E05B 55/005 | 70/156 |
| 3,859,827 | A | 1/1975 | Garcia | | |
| 4,236,396 | A * | 12/1980 | Surko, Jr. | E05C 1/163 | 292/169.22 |
| 4,268,075 | A | 5/1981 | Allenbaugh | | |
| 4,301,667 | A * | 11/1981 | Best | E05B 55/005 | 292/1.5 |
| 4,516,798 | A * | 5/1985 | Bergen | E05C 1/163 | 292/146 |
| 5,322,333 | A | 6/1994 | Norton, II et al. | | |
| 5,676,407 | A * | 10/1997 | Smallegan | E05B 13/005 | 292/139 |
| 5,758,527 | A * | 6/1998 | Crepinsek | E05B 55/005 | 70/151 R |
| 5,794,991 | A * | 8/1998 | Smallegan | E05B 63/126 | 292/150 |
| 6,460,903 | B1 | 10/2002 | Ming-Chih | | |
| 2006/0071484 | A1* | 4/2006 | Chen | E05C 1/163 | 292/169.18 |
| 2009/0064737 | A1* | 3/2009 | Fan | E05B 63/06 | 70/169 |
| 2009/0212576 | A1* | 8/2009 | Chang | E05B 63/0017 | 292/336.5 |
| 2017/0016252 | A1 | 1/2017 | Uhlmann | | |

OTHER PUBLICATIONS

PCT International Search Report and Written Opinion, PCT/EP2020/076900, dated Jan. 19, 2021, 11 pages.

* cited by examiner

DOOR LOCK ADAPTER

CROSS-REFERENCE TO RELATED APPLICATIONS

This application is a continuation of pending International Application No. PCT/EP2020/076900 filed on Sep. 25, 2020 and now published as WO 2021/058741, which designates the United States and claims priority from EP 19199451.6 filed on Sep. 25, 2019. The disclosure of each of the above-identified patent applications is incorporated herein by reference.

BACKGROUND

1. Field of the Invention

The invention relates to an adapter for a door lock actuating mechanism. The adapter enables conversion of a rotary motion of a door handle transmitted by a drive shaft into a translational motion for actuating a door latch.

2. Description of Related Art

DE 2339919 A1 discloses a cylinder lock for actuating a latch module. The latch module is inserted into a recess of a door frame facing narrow side of the door and the cylinder lock into a through hole extending transverse to the longitudinal extension of the latch. The latch module has a housing movably supporting a latch for engaging into a recess of a door frame. A connecting pin movably connects the latch and a coupling arm inside the latch module's housing.

The other side of the coupling arm extends over the latch module's housing into a separately mounted cylinder lock housing. Inside the cylinder lock housing, the coupling arm is connected to an eccentric disk of the cylinder lock. Provided an appropriate key has been inserted into the cylinder lock, the eccentric disk can be rotated by rotation of the key or a doorknob to thereby retract the latch.

U.S. Pat. No. 5,322,333 A suggests a cylindrical lockset comprising a latch bolt, a mechanism for moving the latch bolt between a latched position and an unlatched position, a rotatable cylindrical sleeve operatively engaging the mechanism, an operator secured to the rotatable sleeve, a fixed housing for the mechanism including a threaded sleeve receiving a portion of the rotatable sleeve, a ring shaped spring cassette slidably received by the rotatable sleeve between the threaded sleeve and the operator including a first ring shaped plate, a second ring shaped plate parallel to and axially spaced from the first ring shaped plate, and a coil torsion spring located between the first and second ring shaped plate, means for interconnecting the first ring shaped plate and the threaded sleeve, means for interconnecting the second ring shaped plate and the operator. The first and second ring shaped plates include means for subjecting the coil torsion spring to in increasing stress as the operator is rotated to move the latch bolt from the latched position to an unlatched position.

U.S. Pat. No. 3,203,719 A discloses a spring door latch mechanism with a latch element, spring means normally maintaining said movable latch element in extended latching position, an elongated hollow rotatable member adapted to be mounted on a door and having an assembly slot extending from one end thereof towards the other end thereof, means mounted on said door for journaling said rotatable member for stabilized rotation on a fixed axis, an arm-mounting member slidably received within the hollow portion of said rotatable member to permit assembly in interfitted relation of the mounting and rotatable members, an arm fixed to the arm-mounting member for oscillation by said rotatable member, means connecting said arm to said movable latch element to retract the same against said spring when said rotatable member is rotated, and handle means connected with said rotatable member for facilitating rotation thereof.

U.S. Pat. No. 4,268,075 A relates to a door lock of the dead bolt type. An eccentric cam on the inner end of a lock cylinder can be rotated to engage into a recess in a ring, causing the ring to rotate. A linkage connects the ring to a bolt so that rotation of the ring causes reciprocation of the bolt, the ring being concentric with and supported by the cylinder. The cam engages opposite ends of the recess to move the bolt in opposite directions. A spring, that can be disposed within the bolt, is used to bias the ring toward positions corresponding to extended and retracted positions of the bolt.

In central Europe, so-called case locks are commonly used, which are also known as mortise locks. These mortise locks are mounted into a recess in the door frame facing narrow side of the door which is revealed when opening of the door. These mortise locks have a latch and usually a dead bolt (bolt, for short). At least the latch can be retracted by a door handle to open the door. In so-called anti-panic locks, also the dead bolt is coupled with the inside handle, such that also this bolt is retracted upon actuation of the handle. The mortise lock has a coupling element configured for receiving a shaft of the handle. This coupling element is as well referred to as 'nut'. In a typical configuration, a square shaft supporting the door handle is inserted into the nut and protrudes at least on one side over the door leaf. The nut is a socket for (e.g. form fittingly) receiving the shaft and is configured to provide a torque-proof coupling with the drive shaft. The door handle is placed on this free end in a rotationally locked manner.

Access control of the door is usually controlled by so-called cylinder locks, which are inserted in the (central European) mortise locks. Cylinder locks have a locking cam arranged on a shaft, which cam interacts with the mortise lock. The cylinder lock allows rotation of the locking cam by a user, provided the user is authorized, whereby either a key or a knob is selectively coupled by a clutch with the cam and/or is selectively decoupled from the cylinder lock's housing. In an 'unlocked' state (implying an authorization has been approved), rotation of the key or the knob, respectively actuates the locking cam. The cam interfaces with the mortise lock and rotation of the cam enables to advance and retract the dead bolt and/or the latch.

US 2017/0016252 A1 discloses a door handle for actuating mortise locks as commonly used in central Europe. The door handle has a door-side output shaft and a handle facing away from the door leaf, wherein the output shaft and the handle have a common rotational axis and are connected by a clutch. In case the clutch is open, the handle may be operated, i.e. may be rotated, without entraining the output shaft. When the clutch is closed, however, the handle and the output shaft are non-rotatably connected with each other. Pressing the door handle down thus causes a rotation of the output shaft which is configured to the inserted into said nut of a mortise lock.

U.S. Pat. No. 6,460,903 131 discloses an U.S.-type door lock with an inner knob and an outer knob acting on a door latch. The inner knob is permanently connected to the door latch via an output shaft, such that said door latch can be permanently retracted by a rotation of the inner knob at any time. The outside knob is coupled by a clutch with the inner knob.

SUMMARY

The object of the present invention is to enable operation of a US-style latch module by European style door handle, e.g. as disclosed in US 2017/0016252 A1.

Some embodiments of the invention provide an adapter for a door lock that converts a rotary motion into a translation.

In an embodiment, the adapter can be provided as a module which may be integrated into a door lock or as well may be retrofitted into an already installed door or door lock. Accordingly, almost every door can be retrofitted using said adapter or the adapter can be integrated into almost every door lock.

In use, the adapter converts a rotary motion of a drive shaft of a door lock actuating mechanism (e.g. a door handle) into a translational motion for actuating a door latch. The adapter comprises a housing defining a compartment.

A first lever may be located inside the compartment. As generally understood, a lever is a body pivotable about a fulcrum or an axis of rotation configured for transmitting a torque. The body of the lever may have an elongate shape, e.g. like a rod. Alternatively, the lever may be a disk or a plate or have any other shape known to the person skilled in the art. A first bearing rotatably supports the first lever relative to the housing, defining a first axis of rotation. This first axis of rotation (as well first rotational axis) is the axis of the pivotal movement of the lever. In other words, the bearing pivotably supports the lever inside the compartment relative to the housing. As the person skilled in the art generally understands, a bearing is a machine element, which movably supports two pieces relative to another. For example, the bearing may be a ball bearing, a roller bearing or preferably a plain bearing or any combination thereof. The first bearing may be located for example inside the compartment, e.g. adjacent to the top side and/or the bottom side. The bearing may as well be provided by the housing, at least in part.

The housing may have at least one first channel. The first channel may have at least one channel wall, a first opening and a second opening, wherein the at least one channel wall preferably forms the first and second openings at its respective ends. A first channel axis extends through the first and second openings. The first opening preferably faces the lever, while the second opening preferably faces away from the lever. The channel may be defined by at least one first channel wall(s) (hereinafter walls for short), alternatively two or three walls, preferably four or more walls. The channel walls may form an angle (e.g. be perpendicular to each other) thereby forming a guiding channel and optionally serve e.g. as a linear-motion bearing surface. For example, at least a portion of the channel walls forms a plain bearing surface. Again, it is stressed that a single channel wall may be sufficient. For example, the first channel wall may have a cross section of a ring or of a ring segment. In case of a single ring segment, the channel wall may span an angle of more than 180°, preferably more than 190°or more. For example, the channel wall(s) may enclose a first channel with a polygonal (e.g., rectangular and/or square), circular or elliptic cross section.

The first channel may be a straight channel and thus the first channel axis may be a longitudinal channel axis. The channel axis of the at least one first channel preferably extends at least essentially radially (herein essentially radially means preferably radially, at least within ±15°, preferably within ±5°, particularly preferred within ±2.5 or better (i.e. less)) to the first rotational axis, i.e. the rotational axis of the lever. In other words, the first channel axis may be oriented at least approximately perpendicularly to the first rotational axis, i.e. 90°±15° (preferably 90°±5°, especially preferably 90°±2.5°, or better).

Preferably, a portion of the channel may be open in a direction preferably at least approximately perpendicular (90°±15°, preferred 90°±5°, especially preferred 90°±2.5°, or better) to the first channel axis. In other words, the channel wall(s) may not fully enclose the channel or to say it differently, at least a portion of the channel wall (s) may be recessed at its second opening facing side. As will be explained in more detail below, this additional opening and/or recessed second opening facing side simplifies an optional attachment of latch module to the adapter.

The first lever may have a hole, e.g. a through hole, configured for receiving a drive shaft of a door handle. For example, the hole may have a circular cross section, alternatively a polygonal, e.g. hexagonal, preferably square cross section. When mounted, the longitudinal axis of the drive shaft (i.e. the drive shaft axis) is preferably at least essentially (±15°, preferably ±5°, particularly preferred ±2.5 or better) aligned with and/or at least at least essentially (±15°, preferably ±5°, particularly preferred ±2.5 or better) parallel to the first axis of rotation.

When the adapter is installed as intended, the first axis of rotation is preferably at least essentially (±15°, preferably ±5°, particularly preferred ±2.5 or better (i.e. less)) perpendicular to the door leaf.

The first lever may have coupling means for providing a torque proof coupling with the drive shaft. Preferably the torque proof coupling may be obtained by a positive locking connection of the drive shaft and the coupling means, alternatively the coupling means may be force locking. Examples can be a pin, a clamp, a bayonet mount or any coupling known to the person skilled in the art. Thereby, the adapter and especially the lever can be driven by a rotation of the drive shaft, after being coupled to the lever. In a particularly preferred embodiment, the cross section of the hole is polygonal (e.g. square) and the drive shaft as well has a polygonal cross section configured for a torque proof engagement of the drive shaft with the hole.

A second bearing may pivotably, e.g. rotatably, attach a first end section of a first connecting rod to the first lever. Hereinafter, we will refer to this first end section as the proximal end. The second bearing may be for example a hooklink connection, alternatively a ball bearing, preferably a roller bearing, especially preferred a plain bearing or any combination thereof. Of course, any other bearing known to the person skilled in the art may be applied as well. Relevant is only, that a pivotal movement of the lever causes a displacement of the first end section of the connecting rod. The second bearing has a second axis of rotation which is preferably at least essentially parallel (±15°, preferably ±10°, more preferred ±5° or even less, e.g. ±1°) to the first axis of rotation. Thus, the first connecting rod may pivot (or rotate) relative to the lever, wherein the center of rotation is defined by the second axis of rotation. The distance between first and second axes of rotation thus defines the lever arm d, with d>0 (below, we will use d1, d2 to distinguish between a first and a second lever arm) when actuating the connecting rod by pivoting the lever.

In a preferred example, the second bearing integrates a freehub, thereby enabling to push a latch being connected to the connection rod, while the door handle remains in position. Thus when 'slamming' the corresponding door, the latch may move without entraining the door handle.

The second axis of rotation is preferably located at or in the vicinity of a distal end of the lever but in any case, the first and second axes of rotation are not identical. Thus, the lever arm is greater than zero. As usual, the term distal end denotes an end section at the end facing away from the driveshaft. In other words the distal end is a section of the lever that is spaced from the first axis of rotation at least by half of the lever length, preferably by at least ⅔ of the lever length, by at least ¾ of the lever length or by ⅘ of the lever length. The proximal end is defined accordingly as the end section being opposite the distal end.

The first connecting rod preferably has a first connecting element. The first connecting element may be positioned at a second end section (i.e. the distal end) of the connecting rod. As usual the second end section is a section of the connecting rod at the end opposite to the first end section (proximal end, herein). The connecting element may be attached to the connecting rod in any way, provided a translation of the second end section of the connecting rod causes a translation of the connecting element. The connection may be provided by a bearing, alternatively by an adhesive bond. Preferably, the connecting element and the connecting rod are monolithic. A monolithic design has the advantage of reduced assembly costs.

Preferably, the connecting element is positioned in the first channel and movably supported relative to and/or by the first channel, e.g, by the plain bearing surface of the channel walls(s). The channel wall's plain bearing surface may thus movably support the first connecting element (which in turn has a complementary plain bearing surface) and thereby limits the connecting element's motion and thus motion of the connecting rod's respective end in at least one direction perpendicular to at least one channel wall(s). For example, the channel wall(s) may provide at least one bearing surfaces enabling a translation of the connecting element in the first channel. The (first) connecting rod may thus extend through the (first) first opening into the (first) channel. As will be explained below, there may be a second connecting rod extending through a second first opening into a second channel, wherein the second connecting rod may be connected to a second lever with a second lever arm d2.

Thus, a rotation of the (first and/or second) lever transforms into a translation of the (first and/or second) connecting element (, respectively).

Simply coupling the (i.e. one of the) connecting element(s) to the latch enables to operate the latch by pivoting a handle bar having a drive shaft being coupled to the hole.

Preferably, the connecting rod may have an elongate body being optionally curved. Alternatively, the connecting rod may be straight. A curved shape may minimize the possibility of jamming the connecting rod in the channel.

The connecting element preferably has coupling means for releasably connecting the connecting element and thus the connecting rod with a connecting member of the latch. For example, the coupling means may comprise an elastically deformable recess configured to receive (and attach to) e.g. a spherical ball end of a latch module. Other connection elements, i.e. other coupling means may be used as well. For example, the connecting element may have a first jaw and optionally a second jaw. The jaws may be stationary, or the jaws may have a clamping mechanism. Alternatively, the first and the second jaw may be adjustable via a ratchet member. The first jaw and the second jaw may interact with the connecting element of the latch.

The connecting element is preferably configured to form a preferably detachable connection with the connecting member of the latch. Accordingly, when connected, a translation of the connected connection element causes a translation of the connection member of the latch. Thus, by pivoting a drive shaft being coupled with the lever, the latch may be retracted and/or advanced. Since the latch and the adapter are detachably connected the adapter may be retrofitted into almost any door and replaced with ease in case of any defect.

The connecting rod, preferably the connecting element, may be movably supported inside the first channel. The cannel wall(s) may limit a translation of the first connecting element in directions perpendicular to the first channel axis and enable a translation parallel to the channel axis, thus forming linear-motion bearing(s). By only allowing a translation parallel to the channel axis the coupling rod and/or the coupling element has less play, which leads to a longer lifespan of said elements and a more precise tactile response when actuating a door handle.

The (first and/or the second) connecting element is preferably pivotable about a (first third and/or second) third axis of rotation. In a preferred example, the channel wall(s) provide a bearing surface for the coupling means of the respective connecting rod, wherein the surface of the coupling means is configured to move along the channel wall(s) and at the same time provides a rotational degree of freedom enabling to pivot the connection means relative to the first channel axis, preferably around a third axis of rotation, wherein the third axis of rotation is at least essentially (±15°, preferably ±5°, particularly preferred ±2.5 or better (i.e. less)) parallel to the first axis of rotation.

Particularly preferred, the coupling means may provide a bearing surface, as well. The bearing surface of the channel wall(s) and the bearing surface of the coupling means may form a plain bearing.

Particularly preferred, the channel wall(s) may define an at least essentially constant (±15%, preferably ±5%, particularly preferred ±2.5% or better (i.e. less)) channel diameter (along the channel axis). Of course, the channel may have end sections where the diameter is enhanced, but at least a middle segment in between of two end sections preferably has said at least essentially constant diameter.

The optional bearing surface of the coupling means may have, e.g. at least two sections being rotationally symmetric relative to the third rotational axis. This is a cost efficient and however reliable measure to enable the coupling means to translate inside the channel and at the same time rotate inside the channel while guiding the coupling element essentially with no radial play with respect to the channel axis e.g. by the channel wall(s).

The first axis of rotation is defined by the first bearing. The second axis of rotation is defined by the second bearing. By actuating the drive shaft, the corresponding torque is transmitted to the lever by the coupling means and the lever is pivoted about the first axis of rotation. By the second bearing, the first end section of the connecting rod is translated along the trajectory of the second rotational axis. The second end of the connecting rod is guided in the channel (e.g. by the channel wall(s)), thus, while pivoting the lever, the connecting rod is translated and pivoted as well. The connecting rod is pivoted relative to the lever about the second axis of rotation, while the second axis of rotation is pivots with the lever. At the same time, the connecting element is pivoted relative to the housing about the third axis of rotation, whereby the connecting rod and/or the connecting element is translated within the channel along the channel axis.

The adapter may have a second lever inside the housing's compartment. The second lever is preferably attached to the first lever and/or the coupling means for providing a torque proof coupling with the drive shaft, as well. Alternatively, or in addition, the second lever may have a separate coupling means for providing a torque proof coupling with the drive shaft. The second lever may be connected to a second connecting rod with a second connecting element. The second connecting rod and/or the second connecting element may be located within a second channel. The relation of the second lever, the second connecting rod, the second channel and the second connecting element is the same as the relation of the first lever, the first connecting element, the first channel and the first connecting element. The description of the respective first elements can be read as well on these second elements. Accordingly, the second lever may be movably supported inside the compartment, to pivot around the first axis. The housing may have a second channel, with a second first opening facing the second lever and a second second opening facing away from the second lever. The second lever may be attached to the first lever via an adhesive bond or the second lever and the first lever may be monolithic, to name only two examples. The hole may be positioned in the middle of one or both levers. Alternatively, the first lever and the second lever may each have a hole and a coupling means for providing a torque proof coupling with the drive shaft ex. In this case the first and the second lever may be positioned in juxtaposition and/or with gap relative to each other. Each hole may be configured to interact with the drive shaft, e.g. as explained above with respect to the first lever.

As indicated above, the adapter may further comprise a second connecting rod with a second connecting element attached to or otherwise connected to the distal end of the second connecting rod. The second connecting rod is pivotably attached to the second lever by a further (i.e. second) second bearing, having a further (i.e. second) second axis of rotation, defining a second lever arm d2 by the distance of the second second axis of rotation to the first axis of rotation. Hereinafter, the further second bearing and the corresponding further second axis will be referred to as second second bearing and second second axis. The initially explained second bearing can thus be referred to as 'first second bearing', as well. For simplicity we define that the first first bearing may as well be referred to as first bearing, the first second bearing may be referred to as second bearing, the second first bearing may be referred to as third bearing and the second second bearing may be referred to as fourth bearing. Similarly the axes of rotation of the respective bearings are labeled.

Preferably, the first lever arm and the second lever arm face in opposite directions. Opposite direction corresponds to 180°±20°, alternatively 180°±10°, preferred 180°±5°, especially preferred 180°.

The second connecting element may be moveably supported by the second channel, wherein the second channel wall(s) may limit a translation of the second connecting element in directions perpendicular to the second channel axis and enable a translation parallel to the second channel axis as explained above with respect to the first channel and the first connecting element.

The adapter, at least the housing with the channels, the hole for receiving the drive shaft and the two coupling means for releasably connecting the connecting element with a latch are preferably mirror symmetric with respect to the first axis of rotation or even more preferred with respect to a point on the first rotational axis. This symmetry enables to use the adapter in right hinged doors as well as in left hinged doors, by simply rotating the adapter by 180° relative to a vertical axis (assuming the first axis to be horizontal).

Preferably, a first pin and/or a second pin are configured to interact with a first groove and/or a second groove in the housing. More generally, the groove may be a trench or any other kind of elongated recess. The recess may have the shape of a ring or a ring segment. Preferably, the first pin and/or the second pin may be movably supported in the at least one recess, wherein a pin axes of the first pin and/or second pin may be oriented at least essentially orthogonal to the direction of elongation of the recess, the latter being preferably at least essentially orthogonal to the first axis. Herein at least essentially orthogonal (or parallel) is preferably orthogonal (parallel), wherein small deviations can be accepted. Small deviations include deviations within ±20°, preferably within ±15°, more preferred within ±10°, within ±5° with ±2.5° or less.

In a preferred example, the housing has at least one, preferably two, elongated recesses (i.e. grooves) per second bearing. A first and/or a second pin may movably connect the first and/or second lever with the respective connecting rod, thereby forming a part of the first or second second, bearing respectively. The (at least one) pin may engage into said at least one elongated groove, thereby providing a bearing of the first or the second lever, respectively, relative to the housing and thus forming part of the first first and/or second first bearing, as well. When pivoting a lever, the respective pin being coupled to the lever slides through the groove. Thus, as apparent the width of the groove(s) is(are) configured to limit a translation of the pin(s) perpendicular to the longitudinal extension of the groove(s). The grooves thus may provide two at least essentially parallel bearing surfaces, enabling a movement of the pins along a trajectory and limiting the movement perpendicular to the trajectory.

Preferably, the longitudinal axis of the pin(s), hereinafter the pin axes, are aligned with the respective first second or second second rotational axis, thus the pins may as well be used as a connection pin of a second bearing. In this example, the radial position of the pin axis relative to the first rotational axis defines the respective lever arm. This vastly simplifies design and assembly of the adapter:

For example, in case the lever arm shall be constant when pivoting the lever, the recess(es) may (each) be a groove in the shape of circular ring or a circular ring segment, wherein the center of the respective ring is positioned (at least essentially) on the first rotational axis. However, this is only an example, as the lever arm can be changed automatically when pivoting the lever by providing a radially extending slot (e.g. a radial slot) for the respective pin in a lever: The distance of the groove as a function of the angular position relative to the first rotational axis thus defines the lever arm at each respective angular position. By accordingly adjusting the shape of the at least one groove, the lever arm can be adjusted as a function of the angular position of the lever.

In a very vivid example, there are preferably two levers attached to another, i.e. a first lever and a second lever. Each lever, as explained above, may be connected by a second bearing to a connecting rod. For example, a pin may extend in a recess of the lever, e.g. through the distal end of each lever and rotatably support a proximal end of one of the two connecting rods. Each of the two pins extends with both free ends into an, e.g. circular, groove of the housing, thereby rotatably supporting the levers inside the housing and rotatably attaching a connecting rod to its respective lever. Thus, there are only two pins which provide the first and two second bearings.

Preferably, the recess(es) of the lever(s) is(are) open to the side which faces way from the distal end of connection rod being connected by a pin to the respective lever. Thereby, the corresponding connection rod can be pushed to move further into the compartment without entraining the respective lever. A movement of the lever in the direction facing away from the distal end of the connection rod however entrains the connection rod, as the movement of the lever is transferred via the pin to the connection rod. The second bearing thus integrates a freehub enabling to push a latch being connected to the distal end of the connection rod towards the first axis without entraining a door handle being coupled to the lever.

In a preferred example, a first spring is configured to interact with the first pin and/or a second spring is configured to interact with the second pin. This enables to bias the first and/or second lever against a first and/or second stop. For example, at least one of the springs may be positioned inside the groove with a first end abutting a first end of the groove and a second end abutting the respective pin. This example is particularly rigid, cost efficient in assembly and enables to reduce the minimum over all dimensions of the adapter.

Preferably, at least one of the first lever and/or the second lever have a first lever element and a second lever element both having a distal end. At least a portion of the first and/or second connecting rod, respectively may be positioned in between of the first lever element and the second lever element. For example, a first lever element and a second lever element (of an example first and/or second lever) may each have a distal end with a gap in between the distal ends. The proximal end of the corresponding first or second connecting rod may be supported by the second radial bearing in between of the two distal ends.

This construction is particularly failsafe and cost efficient. For example, the connecting rod may be movably connected to the two distal ends by a pin, wherein the pin preferably extends over the lever into a groove of the housing as explained above.

The housing may comprise at least a first drive opening and/or a second drive opening both being configured for receiving the drive shaft, i.e. the first drive opening and/or a second drive opening are preferably centered on the first rotational axis and have a diameter being greater than the diameter of the drive shaft, enabling a rotation of the optional drive shaft relative to the housing.

Preferably, the adapter has at least one stop, limiting the angle within which the first and/or the second lever(s) can be pivoted relative to the housing. For example, the housing and the respective lever (s) may each have a stop abutting each other if respective lever(s) reach the end of a preferably predefined pivoting range. Thus the at least one stop enables to restrict the pivoting range. This enables for example to bias the lever and thus an (optional) door handle against a stop to thereby ensure a door handle returns in a predefined position, once released. Further, damage to the latch module or an unintentional decoupling of the adapter from a latch module can be prevented by limiting the pivoting range.

Explanation of the embodiments of the invention refer to a door leaf, a door frame, a door handle and a drive shaft being driven by the door handle. Generally, however, embodiments of the invention relate to the adapter that can be sold/distributed independently or in a kit with at least one of the above listed parts. For example, the kit may comprise a latch module, wherein the latch module has a module housing and latch being movably supported relative to the module housing. As usual the latch may extend over the housing and may be retractable, e.g. by pulling a pull rod extending at the opposite side of the housing.

Thus, the latch may be connected to a pull rod having a connector end and pulling the connector end results in a retraction of the latch. The adapter as explained above has a connecting element, being configured to be attached, preferably releasably attached, to the connecting end. Accordingly, a rotation of the lever thus causes corresponding translation of the latch.

BRIEF DESCRIPTION OF THE DRAWINGS

In the following, the invention will be described by way of example, without limitation of the general inventive concept, on examples of embodiment and with reference to the drawings.

Figure 1:
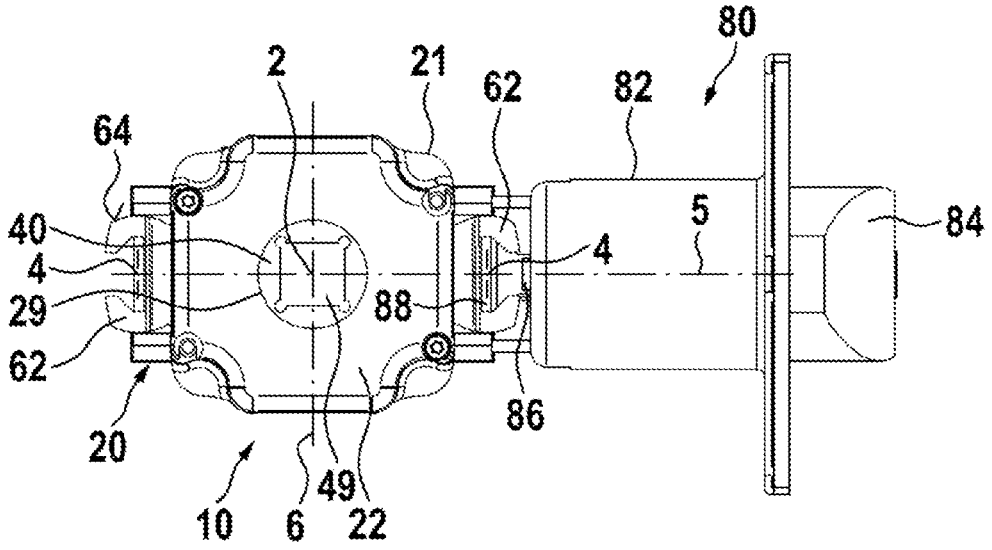
FIG. 1 shows a side view of an adapter being connected to a latch module.

Generally, the drawings are not to scale. Like elements and components are referred to by like labels and numerals. For the simplicity of illustrations, not all elements and components depicted and labeled in one drawing are necessarily labels in another drawing even if these elements and components appear in such other drawing.

While various modifications and alternative forms, of implementation of the idea of the invention are within the scope of the invention, specific embodiments thereof are shown by way of example in the drawings and are described below in detail. It should be understood, however, that the drawings and related detailed description are not intended to limit the implementation of the idea of the invention to the particular form disclosed in this application, but on the contrary, the intention is to cover all modifications, equivalents and alternatives falling within the spirit and scope of the present invention as defined by the appended claims.

DETAILED DESCRIPTION

Figure 6:
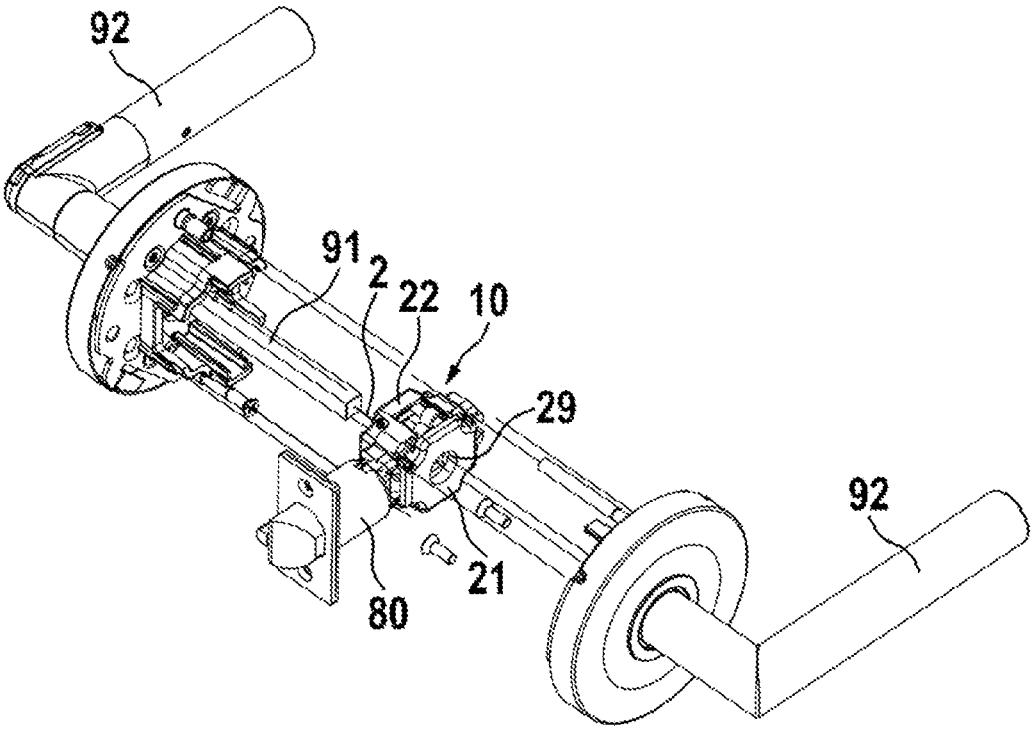
FIG. 6 shows an example for combining the adapter with a shaft and door handles.

FIG. 1 shows an adapter 10 being connected to an optional latch module 80. The latch module 80 has a latch module housing 82 and a latch 84 being retractably supported by the latch module housing 82. A front side of the latch 84 extends over the housing and is configured to engage into a complementary recess of a door frame. A pull rod 86 with a connecting member 88 may extend over the opposite side of the latch module housing 82 and may be connected to the latch 84. Thus, pulling the connecting member 86 causes a retraction of the latch 84 as depicted in FIG. 6.

The pull rod 86 may pulled by the adapter 10. The adapter 10 has a housing 20, e.g. with a first housing portion 21 and a second housing portion 22.

Figure 4:
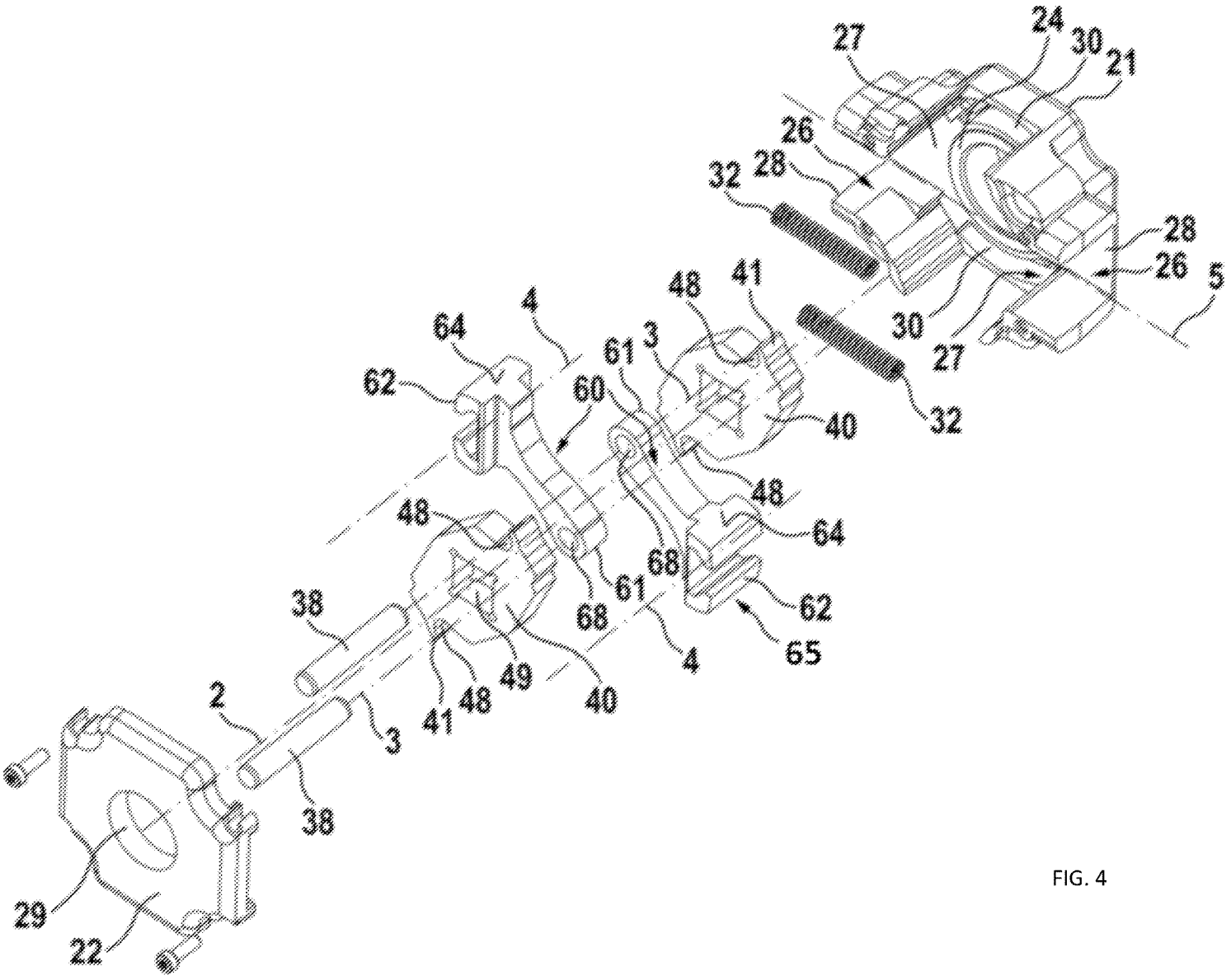
FIG. 4 shows an exploded view of the adapter of FIGS. 1 to 3.

Inside the housing 20 is a compartment 24 (see FIG. 4). When assembling, the first housing portion 22 can be used as a bottom housing portion 22 being closed in a final step by attaching a cover 22, namely the second housing portion. The housing 20 may have drive openings 29.

Figure 2:
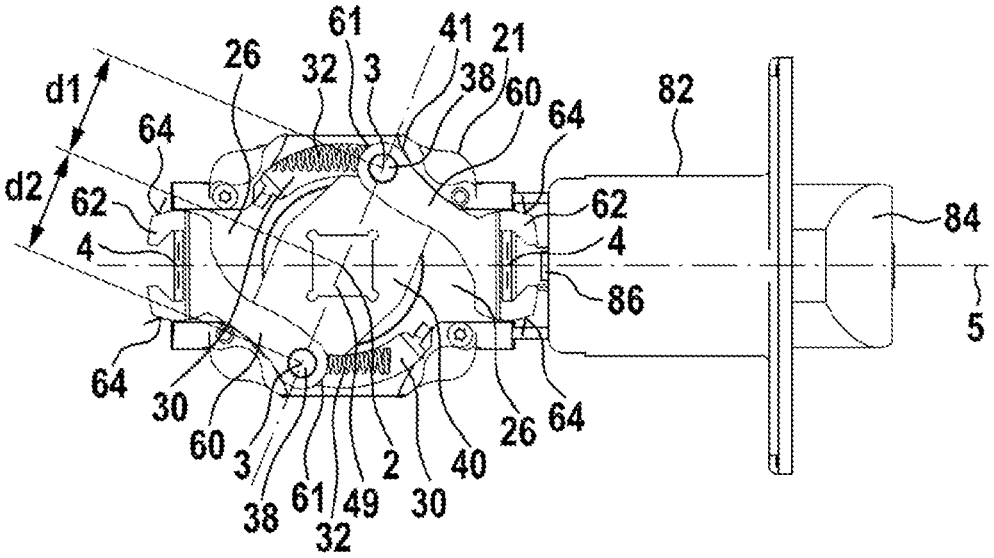
FIG. 2 shows the side view of FIG. 1, wherein a cover of the adapter has been removed.
Figure 3:
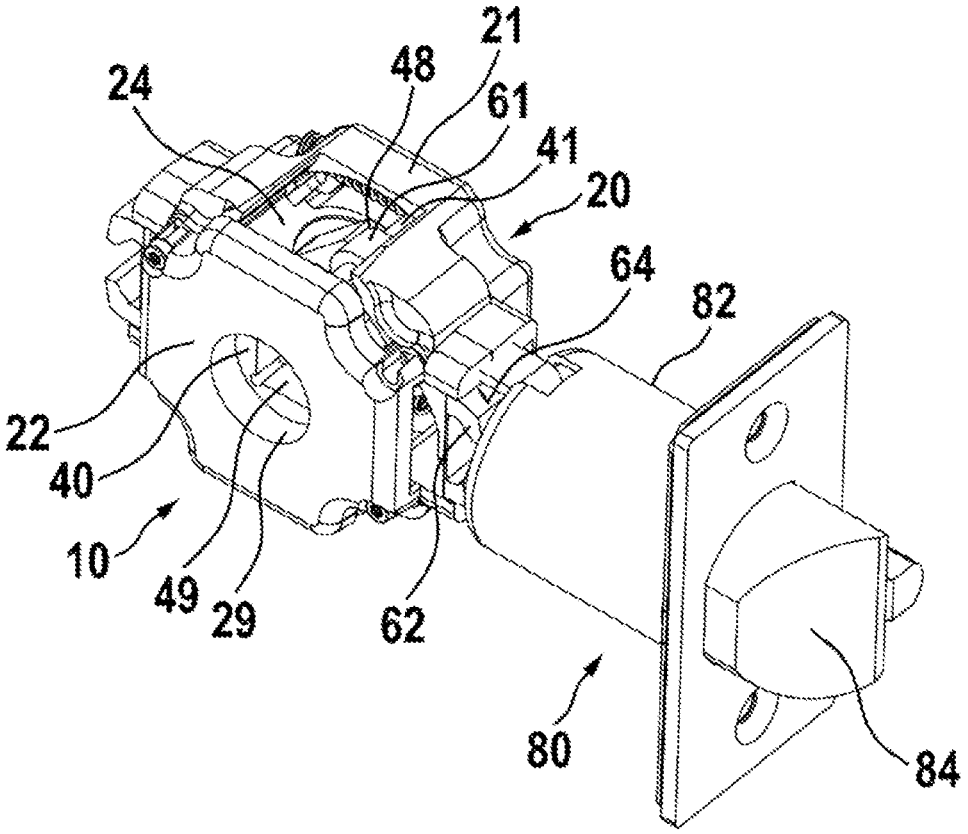
FIG. 3 shows as perspective view of the adapter of FIG. 1 being connected to the latch module.
Figure 5:
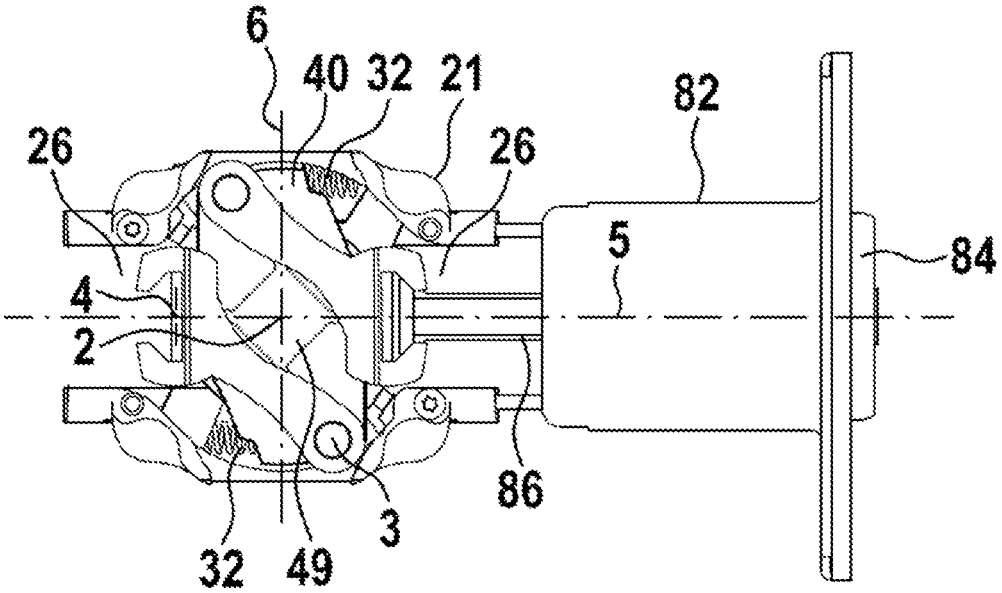
FIG. 5 shows a side view of an actuated adapter of FIGS. 1 to 4 being connected to the latch module, wherein a cover of the adapter has been removed

Inside the compartment can at least one, e.g. as depicted be two lever elements 40 (see FIGS. 3, 4 and 5). In this preferred example, each lever element 40 is part of two levers, i.e. of a first lever and a second lever as indicated by the lever arms d1 and d2 (see FIGS. 2 and 5). The levers d1, d2 may be rotatably mounted inside the compartment and thus have a rotational axis 2. Further, each lever element 40 may have a hole 49. In this example the holes 49 are centered with the rotational axis 2 and form a coupling element enabling a torque proof coupling with a drive shaft, e.g. with a polygonal shaft, in particular with a square shaft 91 (see FIG. 8).

As apparent from FIGS. 2, 4 and 5 each lever element 40 may be rotatably supported inside the housing by a radial bearing, wherein the radial bearing is preferably at least partially integrated in the housing: In the depicted example, each lever d1, d2 has a distal end 41, i.e. an end section which faces away from the first rotational axis 2. As in this particular example, each lever d1, d2 may be formed by two lever elements 40, thus there may be (e.g.) four distal ends 41. In each distal end 41 is a recess 48 which provides a support for a first or a second pin 38. Here, the recess has the contour of a ring segment, but the recess may as well be through hole. The two optional pins 38 may preferably extend axially over the lever elements 40 into optional grooves 30 in the housing 20, i.e. in the walls defining the compartment 24. The grooves 30 may have the form of ring segments wherein each of the corresponding ring segments is centered around the first rotational axis 2. Accordingly, the two lever elements 40 may pivot around the first axis 2 inside the housing 20, while the ends of the pins 38 travel inside the grooves 30. At least one end of a ring segment may provide at least one block for at least one of the pins 38 and thereby limit the pivoting range. A spring 32 may be positioned inside at least one of the grooves 30 biasing the lever arms d1, d2, e.g. in a first rotational direction, e.g. against the at least a one block.

The two lever elements 40 may be spaced, e.g. in axial direction, from each other with a gap in between, wherein the gap may for example extend parallel to the first longitudinal axis (see FIGS. 2, 3, 4, and 5). In between of the lever elements 40 may be at least one connecting rod 60. As an example, two connecting rods 60 are depicted. Each connecting rod 60 may be pivotably attached to a lever d1, d2, i.e. at a distance d1, d2 from the first rotational axis 2 by one of the pins 38, which may extend, e.g. through a recess 68 of the connecting rod 60. The first end section 61, which is attached to a lever d1, d2, is referred to as proximal end 61 of a connecting rod 60. The second end section is referred to as distal end 62 of the at least one connecting rod 60. The distal end 62 of the connecting rod 60 may have (or be configured as) a connecting element configured for being (e.g. removably) attached to the connecting member 88. For example, the connecting member 88 may have a diameter that increases with increasing distance from the module housing 20. The connecting element (the distal end 62) may have a recess configured for receiving the connecting member 88, while the portions of the connecting element 62 defining the recess may engage behind at least a portion of the connecting member 88, when coupled as depicted in FIGS. 1 to 3 and 5.

The connecting elements 62 may be movably supported relative to the housing 20. In the example, the housing 20 has at least one channel 26 with a first channel opening 27 facing towards the at least one lever d1, d2 and a second opening 28 facing away from the at least one lever d1, d2. A channel 26 may have at least one channel wall which may provide a bearing surface for a connecting element 62. Thus, a rotation of a lever d1, d2 from the position depicted in FIG. 1 to FIG. 3 into the position depicted in FIG. 5, e.g. by actuating a door handle 92 (see FIG. 8) pulls the connecting rods 60 further in the compartment 24. Thereby, the proximal end 61 of the connection rod 60 rotates around a second rotational axis 3 (see FIGS. 2 and 5), which is the longitudinal axis of the respective pin 38 (see FIG. 4). The connecting element 62 at the distal end 62 of the connecting rod 60 has two opposed convex surfaces 64 being at least essentially rotational symmetric to a third rotational axis 4, thereby forming with the wall(s) of the channels 26 a plain bearing that allows a translation along the channel axis 5 and at the same time a rotation of the connecting rods 60 around the third rotational axes 4. This rotation may be supported by at least one section 64 of the outer surface of the connecting element 65, which at least one section 64 of the outer surface is preferably rotational symmetric to the third rotational axis 4. As apparent from FIGS. 2, 4 and 5, at least two of the first, second and third rotational axes may be at least essentially parallel to each other. The channel axis 5 is preferably at least essentially orthogonal to the first rotational axis 2.

As can be seen, e.g. in FIG. 1, 3 and, a portion of the channel(s) 26 may be open in a direction parallel with the first rotational axis 2. This simplifies mounting the assembly, as in a first step, a latch module like e.g. the latch module 80 may be inserted in a corresponding recess in a door frame facing narrow side of a door leaf. Subsequently, the adapter can be inserted from the front or rear side of the door leaf in a corresponding recess and thereby the coupling member 88 may slide sideways (i.e. parallel with the movement of the adapter 10) into a recess of the connecting element 65.

As can be seen e.g. in FIG. 4, the recesses 48 of the lever elements 40 may be open to one end. Preferably to the end which faces away from the distal end of the connection rod 60 which is connected to the pin 38 extending through the respective recess 48. These openings of the recesses enable the pins 38 to pivot perpendicular to their longitudinal axis in the grooves without entraining lever the elements 40. Accordingly, the connection rods 60 can be pushed to move further into the compartment 26 without entraining the lever elements 40. The latch can thus be pushed to move towards the first axis 2, while lever and thus a handle bar 92 as depicted in FIG. 6 remains in its initial (e.g. horizontal) position. Thus, the second bearing integrates a freehub.

FIG. 6 illustrates how the adapter may be coupled to at least one door handle 92 by a shaft 91.

It will be appreciated to those skilled in the art having the benefit of this disclosure that implementations of the idea of this invention provide an adapter for combining a European style door handle with an US-style mortise lock. Further modifications and alternative embodiments of various aspects of the invention will be apparent to those skilled in the art in view of this description. Accordingly, this description is to be construed as illustrative only and is provided for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

2 axis
3 axis
4 axis
5 channel axis
6 vertical axis
10 adapter
20 adapter housing
21 first housing portion
22 second housing portion (cover)
24 compartment
26 channel
27 first channel opening
28 second channel opening
29 drive opening
30 groove/recess
32 spring
38 pin
40 lever element
41 distal end
48 recess, preferably through hole
49 (through) hole
60 connecting rod/connecting element
61 first end (proximal end)
62 second end (distal end)
64 section of outer surface, e.g. cylinder surface section
68 recess
80 latch module
82 housing of latch module/module housing
84 latch
86 pull rod
88 connecting member
91 shaft
92 door handles
d1 first lever, first lever arm
d2 second lever, second lever arm

The invention claimed is:

1. An adapter configured to convert a rotary motion of a drive shaft for a door lock actuating mechanism into a translational motion for actuating a door latch, wherein the adapter comprises a housing with a compartment and a lever structure inside the compartment, wherein:

the lever structure comprises at least one of a first lever element and a second lever element and defines a first lever arm and is rotatably supported by a first bearing, wherein the first bearing has a first axis of rotation, the housing has a first channel, and the first channel has a first opening facing the lever structure and a second opening facing away from the lever structure, wherein a first channel axis extends through the centers of the first and second openings, the lever structure has a hole, configured to receive the drive shaft and as a first coupling means to provide a torque proof coupling with the drive shaft, a second bearing is configured to pivotably attach the lever structure to a first connecting rod, wherein the second bearing has a second axis of rotation separated from the first axis of rotation by the first lever arm, the first connecting rod has a first connecting element at a distal end of the first connecting rod opposite to the second bearing, the first connecting element is moveably supported inside the first channel, wherein first channel walls limit a translation of the first connecting element in directions perpendicular to the first channel axis and enable a translation along the first channel axis.

2. An adapter according to claim 1, wherein:

the housing has a second channel, with a third opening of the second channel facing the lever structure and a fourth opening of the second channel facing away from the lever structure, wherein the second channel axis extends through centers of the third and fourth openings, the lever structure further comprises a second connecting rod with a second connecting element at a distal end of the second connecting rod, and the second connecting rod is pivotably attached to the lever structure by a third bearing that has a third axis of rotation that is separated from the first axis of rotation by a second lever arm of the lever structure, the second connecting element is moveably supported by the second channel, wherein second channel walls limit a translation of the second connecting element in directions perpendicular to the second channel axis and enable a translation parallel to the second channel axis.

3. An adapter according to claim 2, wherein at least the housing with the first channel and the second channel, the hole, and the first coupling means configured to releasably connect a connecting rod, from the first and second connecting rods, with a latch of a door lock are symmetrical with respect to the first axis of rotation.

4. An adapter according to claim 2, wherein the first connecting rod is pivotably connected to the lever structure by a first pin and the second connecting rod is pivotably connected to the lever structure by a second pin.

5. An adapter according to claim 4, wherein the first pin and the second pin are movably supported in at least one recess, wherein a pin axis of the first pin and a pin axis of the second pin are oriented at least essentially parallel to an axis defined by the ring segment.

6. An adapter according to claim 4, further comprising at least a first spring configured to bias the first pin and/or a second pin in a first direction.

7. An adapter according to claim 2, wherein:

the at least one of a first lever element and a second lever element includes both the first lever element and the second lever element, and the first connecting rod and second connecting rod are positioned between the first lever element and the second lever element.

8. An adapter according to claim 2, wherein the first connecting element is pivotably supported in the first channel to enable a pivotable movement about a fourth axis of rotation and/or the second connecting element is pivotably supported in the second channel to enable a pivotable movement about a fifth axis of rotation.

9. An adapter according to claim 2, wherein the adapter has at least one stop that limits an angle within which the first lever element and/or the second lever element can be pivoted relative to the housing in at least one direction.

10. An adapter according to claim 2, wherein each of the first connecting element and the second connecting element has a coupling configured to be attached with a latch connecting member of the latch.

11. An adapter according to claim 10, wherein said coupling is a releasable coupling.

12. An adapter according to claim 2, wherein the first connecting rod is pivotably supported in the first channel to enable a pivotable movement about a fourth axis of rotation and the second connecting rod is pivotably supported in the second channel to enable a pivotable movement about a fifth axis of rotation.

13. An adapter according to claim 1, wherein the housing has at least one recess, wherein the at least one recess has a form of a ring segment.

14. An adapter according to claim 1, wherein the housing comprises a first drive opening and a second drive opening, which are configured to accept the drive shaft.

15. An adapter according to claim 1, wherein the housing is disassemblable.

16. An adapter according to claim 1, wherein the first connecting rod is pivotably connected to the first lever by a first pin.

17. A kit comprising a latch module having a module housing and at least one latch that is movably supported relative to the module housing, and wherein the at least one latch is connected to a pull rod having a pull rod connecting member, and wherein the kit further comprises the adapter of claim 1, wherein the first connecting rod is configured to be connected to the pull rod connecting member.

* * * * *